US009076569B2

(12) United States Patent
Okafuji

(10) Patent No.: US 9,076,569 B2
(45) Date of Patent: Jul. 7, 2015

(54) CU—CO—SI ALLOY MATERIAL AND MANUFACTURING METHOD THEREOF

(75) Inventor: Yasuhiro Okafuji, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 236 days.

(21) Appl. No.: 13/637,731

(22) PCT Filed: Mar. 25, 2011

(86) PCT No.: PCT/JP2011/057442

§ 371 (c)(1),
(2), (4) Date: Sep. 27, 2012

(87) PCT Pub. No.: WO2011/122490

PCT Pub. Date: Oct. 6, 2011

(65) Prior Publication Data

US 2013/0019997 A1 Jan. 24, 2013

(30) Foreign Application Priority Data

Mar. 30, 2010 (JP) ..... 2010-077702

(51) Int. Cl.
*C22C 9/06* (2006.01)
*C22F 1/08* (2006.01)
(Continued)

(52) U.S. Cl.
CPC *H01B 1/026* (2013.01); *C22F 1/08* (2013.01); *C22C 1/10* (2013.01); *C22C 9/06* (2013.01); *C22F 1/00* (2013.01); *C22C 9/00* (2013.01)

(58) Field of Classification Search
None
See application file for complete search history.

(56) References Cited

U.S. PATENT DOCUMENTS

2008/0056930 A1 3/2008 Ito et al. ..... 420/477
2010/0326573 A1 12/2010 Mihara et al. ..... 148/686

(Continued)

FOREIGN PATENT DOCUMENTS

JP 2008-56977 3/2008 ..... C22F 1/00
JP 2008-88512 4/2008 ..... C22F 1/00

(Continued)

OTHER PUBLICATIONS

Machine English translation of Japanese patent No. 2008-266787, Kaneko Hiroshi et al., Nov. 6, 2008.*

(Continued)

*Primary Examiner* — Deborah Yee
(74) *Attorney, Agent, or Firm* — Drinker Biddle & Reath LLP

(57) ABSTRACT

A copper alloy material suitable for materials for electronic and electrical equipments such as movable connectors having excellent bending workability and being able to show high electrical conductivity was achieved by a Cu—Co—Si alloy material containing 1.5 to 2.5 wt % of Co and 0.3 to 0.7 wt % of Si, having a Co/Si element ratio of 3.5 to 5.0, containing 3,000 to 150,000 second phase particles per $mm^2$ having diameters of from 0.20 μm or more to less than 1.00 μm, having a grain size of 10 μm or less, an electrical conductivity of 60% IACS or more, and good bending workability. The above alloy material contains 10 to 1,000 second phase particles per $mm^2$ having diameters of from 1.00 to 5.00 μm, the 0.2% yield strength may be 600 MPa or more, the temperature of hot heating performed after casting and before solution treatment is a temperature that is 45° C. or more higher than the solution treatment temperature selected below, the cooling rate from the temperature at the start of hot rolling to 600° C. is 100° C./min or lower, the solution treatment temperature is selected from (50×Co wt %+775)° C. or more to (50×Co wt %+825)° C. or less, and can be manufactured employing aging treatment after solution treatment preferably at 450 to 650° C. for 1 to 20 hours.

5 Claims, 1 Drawing Sheet

(51) Int. Cl.

| | |
|---|---|
| ***H01B 1/02*** | (2006.01) |
| ***C22C 1/10*** | (2006.01) |
| ***C22F 1/00*** | (2006.01) |
| ***C22C 9/00*** | (2006.01) |

(56) References Cited

U.S. PATENT DOCUMENTS

| | | | |
|---|---|---|---|
| 2011/0186192 | A1 | 8/2011 | Mihara et al. |
| 2011/0200479 | A1 | 8/2011 | Mihara et al. |

FOREIGN PATENT DOCUMENTS

| | | | |
|---|---|---|---|
| JP | 2008-266787 | 11/2008 | ..... C22F 1/00 |
| JP | 2009-242814 | 10/2009 | ..... C22F 1/00 |
| JP | 2009-242890 | 10/2009 | ..... C22F 1/00 |
| JP | 2010-59543 | 3/2010 | ..... C22F 1/00 |
| JP | 2010059543 | 3/2010 | |
| WO | WO2009/096546 | 8/2009 | ..... C22F 1/00 |
| WO | WO2010/016429 | 2/2010 | ..... C22F 1/00 |

OTHER PUBLICATIONS

Supplementary European Search Report dated Mar. 11, 2014 in European Application No. 12734565.0.

* cited by examiner

CU—CO—SI ALLOY MATERIAL AND MANUFACTURING METHOD THEREOF

TECHNICAL FIELD

The present invention relates to materials for electronic and electrical equipments having excellent bending workability and being able to show high electrical conductivity, in particular, Cu—Co—Si copper alloy materials suitable for materials for electronic and electrical equipments such as movable connectors.

BACKGROUND ART

Materials for electronic and electrical equipments require properties such as electrical conductivity, strength, and bending workability, and a demand for materials that allow high current is increasing in recent years for electric and electronic parts, particularly for movable connectors. In order to avoid movable connectors such as floating type connectors becoming larger, a material having good bendability as well as securing high electrical conductivity and strength, even at a thickness of 0.2 mm or more, is necessary.

Conventionally, Cu—Ni—Si, Cu—Co—Si, or Cu—Ni—Co—Si copper alloys are known as precipitation strengthened copper alloys having properties that allow for achieving high strength without deteriorating electrical conductivity. In order to manufacture these copper alloys, supplemented element(s) are solutionized by solution treatment, followed by cold rolling and aging treatment to precipitate or crystallize $Ni_2Si$ and $Co_2Si$ etc. as second phase particles in the matrix. However, since the amount of solubility of $Ni_2Si$ is relatively large, it is difficult to achieve an electrical conductivity of 60% IACS or more with a Cu—Ni—Si copper alloy. For this reason, Cu—Co—Si or Cu—Ni—Co—Si alloys containing $Co_2Si$ with low amount of solubility as the main precipitate and showing high electrical conductivity are being researched. The target strength cannot be achieved with these copper alloys unless they are sufficiently solutionized first and then precipitated to form fine precipitates. However, because solution treatment at a high temperature will cause coarsening of crystal grains resulting in problems such as deteriorated bending workability, various countermeasures have been investigated.

In Japanese Published Unexamined Patent Application Nos. 2009-242814 (Patent Document 1) and 2008-266787 (Patent Document 2), in order to manufacture a precipitation strengthened copper alloy for materials for electric and electronic parts such as a lead frame, the effect of suppressing crystal grain growth by second phase particles is utilized to control grain size and to improve bending workability. In the above documents, second phase particles precipitate during the cooling process in hot working or the temperature elevation process in solution heat treatment, as well as during the aging treatment after grinding ([0025] in Patent Document 1 etc.) In addition, International Publication No. 2009/096546 (Patent Document 3) describes a method in which the limitation of grain size and the fine size of precipitates are controlled in a Cu—Co—Si alloy having a specific composition, specifically, a method of controlling grain size by solution treatment temperature, cooling rate after solution treatment, and aging treatment temperature.

Patent Document 1

Japanese Published Unexamined Patent Application No. 2009-242814A

Patent Document 2

Japanese Published Unexamined Patent Application No. 2008-266787A

Patent Document 3 WO2009/096546

DISCLOSURE OF THE INVENTION

Problems to be Solved by the Invention

In general, specific target values for preventing the above movable connectors from becoming larger are an electrical conductivity of 60% IACS or more, and a 0.2% yield strength YS of 600 MPa or more, or a tensile strength TS of 630 MPa or more, as well as the threshold of ratio between the bending radius R and the thickness of material t (MBR/t) without generation of cracks, which is considered an indicator of bending workability, is 0.5 or less (0.3 mm thickness of sheet, Bad Way). This bending workability varies depending on the grain size and the size and number etc. of second phase particles, and the grain size to obtain an MBR/t of 0.5 or less at 0.3 mm plate thickness is thought to be generally 10 μm or less for Cu—Co—Si or Cu—Ni—Co—Si alloys. Crystal grains grow by solution treatment, and thus the grain size is determined by the temperature and time of solution treatment, supplemented element(s), and the size or number of second phase particles.

In Patent Documents 1 and 2, however, Co is not essential and a wide range of second phase particles is targeted. In the method of controlling grain size by second phase particle precipitates described in Patent Document 1, grain size can be controlled but electrical conductivity becomes poor, and high current availability cannot be achieved. Patent Document 2 focuses on second phase particles with diameters of from 50 to 1000 nm as possessing the effect of suppressing the growth of recrystallized grains in solution treatment, but Co second phase particles of this size may sometimes be solutionized and disappear during solution treatment. For this reason, since the temperature and time of solution treatment need to be adjusted so that the precipitates are not solved, only Cu—Co—Si alloys which are poor in either electrical conductivity or bendability were obtained. In addition, the second phase particle precipitates in this size range may possibly precipitate after solution treatment, and thus it does not show direct controlling effect on grain size. Although the density or diameter and volume density of second phase particles on the crystal grain boundary are evaluated by transmission electron microscope (TEM) observation in the above document, when the second phase was precipitated until grain size could be controlled to 10 μm or less, there was a possibility that accurate values could not be determined due to overlapping of particles and the like.

In Patent Document 3, although grain size is controlled to 10 μm or less by varying the solution treatment temperature, the cooling rate after solution treatment, and the aging treatment temperature, Co cannot be solutionized at a concentration of 1.5 mass % or more by means of this method, and the targeted strength cannot be obtained.

As described above, because the purpose of conventional precipitation strengthened copper alloys was utilization of thin sheet for electronic parts such as a lead frame, excellent bending workability at a sheet thickness of approximately 0.3 mm has never been developed.

Means for Solving the Problems

The present inventors have performed intensive and extensive research in order to solve the above problems, and attained the following inventions.

(1) A Cu—Co—Si alloy material consisting of 1.5 to 2.5 wt % of Co and 0.3 to 0.7 wt % of Si and the balance of Cu and unavoidable impurities, having a Co/Si element ratio of 3.5 to 5.0, wherein the said alloy material contains 3,000 to 150,000 second phase particles per $mm^2$ having diameters of from 0.20 μm or more to less than 1.00 μm, and has an electrical conductivity EC of 60% IACS or more, a grain size of 10 μm or less, and good bending workability.

(2) The copper alloy material according to (1), wherein the alloy material contains 10 to 1,000 second phase particles per $mm^2$ having diameters of from 1.00 μm or more to 5.00 μm or less.

(3) The copper alloy material according to (1) or (2), wherein the 0.2% yield strength YS is 600 MPa or more.

(4) A method of manufacturing the copper alloy material according to any of (1) to (3), wherein the temperature of hot rolling performed after casting and before solution treatment is a temperature that is 45° C. or more higher than the solution treatment temperature selected below, the cooling rate from the temperature at the start of hot rolling to 600° C. is 100° C./min or lower, and the solution treatment temperature is selected from the range of from (50×Co wt %+775)° C. or more to (50×Co wt %+825)° C. or less.

(5) The method of manufacturing copper alloy material according to (4), wherein the aging treatment after solution treatment is at 450 to 650° C. for 1 to 20 hours.

In the present invention, the solution treatment temperature is adjusted, the hot heating temperature before solution treatment is also adjusted to be suitable for the solution treatment temperature, and the cooling rate after hot heating is also adjusted to allow precipitation of a particular amount of second phase particles having a particular grain size in order to prevent coarsening of crystal grains in the manufacturing of a Cu—Co—Si alloy material having a particular composition. Grain size of 10 μm or less can be obtained by adjusting the above second phase particles, and therefore bending workability, electrical conductivity that allows high current as well as practicable strength, suitable for movable connectors can be achieved.

BEST MODES FOR CARRYING OUT THE INVENTION

1. Cu—Co—Si Alloy Material

Figure 1:
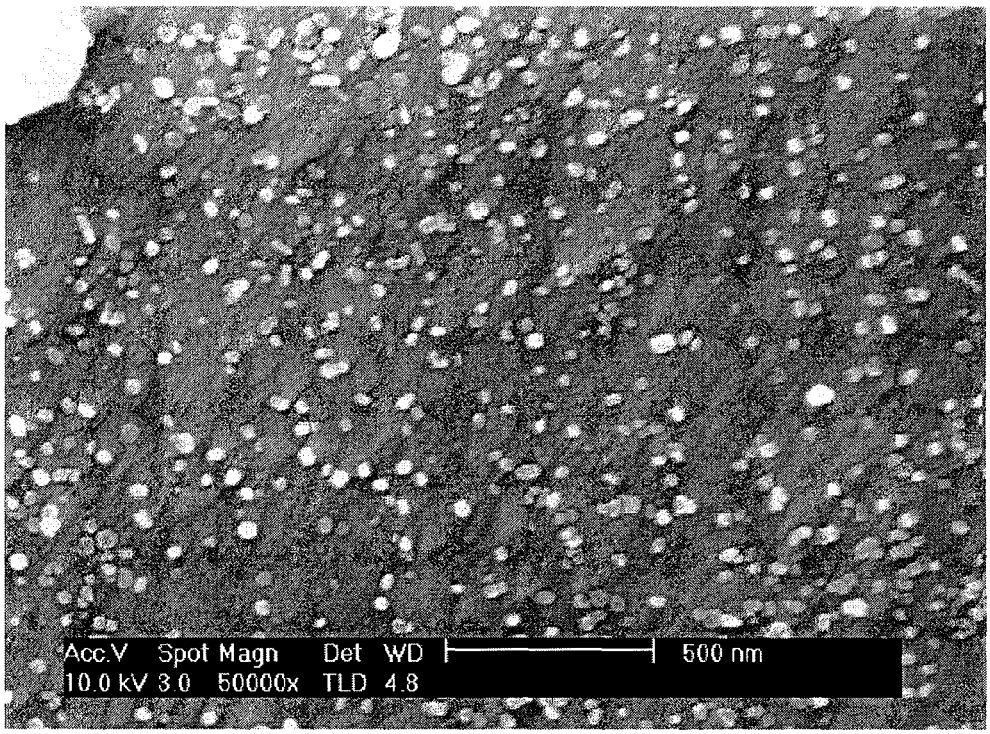
FIG. 1 is a scanning electron microscope (SEM) photograph ($5\times10^4$-power) taken in Example 3.

The alloy material of the present invention contains 1.5 to 2.5 wt % (hereinafter shown as % unless otherwise indicated), preferably 1.7 to 2.2% of Co, and 0.3 to 0.7%, preferably 0.4 to 0.55% of Si. The remainder preferably consists of Cu and unavoidable impurities, but various elements employed by those skilled in the art as components ordinarily added to copper alloys, e.g., Cr, Mg, Mn, Ni, Sn, Zn, P, and Ag etc. within the range that allows achievement of the effect targeted by the constitution of the present invention may be further included.

The stoichiometric ratio of Co/Si contained is theoretically 4.2, but is actually 3.5 to 5.0, preferably 3.8 to 4.6. If the ratio is within this range, second phase particles $Co_2Si$ suitable for precipitation strengthening and adjustment of grain size is formed. If Co and/or Si are too low, precipitation strengthening effect will be reduced, and if it is too high, it will not be solutionized and electrical conductivity will also be poor. When second phase particles $Co_2Si$ precipitate, precipitation strengthening effect appears, and the purity of the matrix will increase after precipitation, thus improving electrical conductivity. Further, if a particular amount of second phase particles having a particular size is present, the growth of crystal grains is prevented and the grain size can be made to be 10 μm or less.

The grain size of the alloy material of the present invention is 10 μm or less. Ten micrometers or less allows achievement of good bending workability.

The copper alloy material of the present invention may have various shapes, such as for example plates, strips, wires, rods, and foils, and without particular limitation, may be plates or strips for movable connectors.

2. Second Phase Particles

Figure 2:
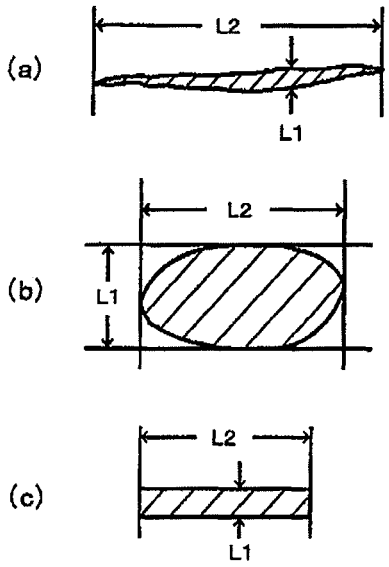
FIG. 2 is a reference drawing describing a diameter of second phase particle.

The second phase particles of the present invention refer to particles that generate when other elements are contained in copper to form a phase different from the copper mother phase (matrix). The number of second phase particles having diameters of 50 nm or more is obtained, after mirror finishing by mechanical polishing followed by electrolytic polishing or acid wash etching, by counting the number of particles having diameters in the corresponding range on a field of a scanning electron microscope photograph (see FIG. 1) obtained by arbitrary five points selection in a cross-section of a copper alloy sheet parallel to rolling direction. The diameter as used herein refers to the average of L1 and L2 as shown in FIG. 2 obtained by measuring the minor axis (L1) and the major axis (L2) of the particle.

Most of the second phase particles of the present invention are $Co_2Si$, but other intermetallic compounds such as $Ni_2Si$ may also exist as long as the diameter is within the range. Elements that constitute second phase particles can be confirmed for example by using EDX (Energy-Dispersive X-Ray) accompanying FE-SEM (FEI Company Japan, Model XL30SFEG).

The copper alloy material of the present invention contains 3,000 to 150,000/$mm^2$, preferably 10,000 to 120,000/$mm^2$, and further preferably 13,000 to 100,000/$mm^2$ second phase particles having diameters of from 0.20 μm or more to less than 1.00 μm. The particles precipitate mainly after hot heating and before solution treatment, but may also precipitate by solution treatment. The second phase particles that precipitated before solution treatment suppress the growth of grain size in solution treatment, but there is also risk of solid solution thereof. Accordingly, it is preferred to adjust the solution treatment conditions to reduce variation in number as much as possible.

In addition, the material preferably comprises 10 to 1,000/$mm^2$, further preferably 20 to 500/$mm^2$, and most preferably 30 to 400/$mm^2$ second phase particles having diameters of from 1.00 μm or more to 5.00 μm or less, the cooling rate after hot rolling is slowed down for precipitation, and first aging treatment can be applied if necessary in order to adjust grain size. The above preferred range is also linked with the number of second phase particles of from 0.20 μm or more to less than 1.00 μm. High temperature solution treatment is possible under the conditions of the above range and the growth of grain size in solution treatment is suppressed, while the sufficiently solutionized Co and Si are finely precipitated by a later (second) aging treatment, resulting in high strength, high electrical conductivity, and good bending workability to be achieved. However, the number of second phase particle greater than 1,000/mm$^2$ are not preferred because bendability will be reduced.

The number of second phase particles having the above diameters of from 0.20 μm or more to less than 1.00 μm and 1.00 μm or more to 5.00 μm or less can be evaluated using a test strip obtained before final rolling, since the number does not vary considerably before and after solution treatment as well as after second aging treatment.

Since precipitation of fine second phase particles is inhibited and precipitation strengthening effect cannot be obtained if second phase particles having diameters greater than 5.00 μm exist, the number of contained particles having the above diameters is preferably 1/mm$^2$ or less, further preferably only 0.01/mm$^2$ or less.

Although the second phase particles of from 0.05 μm or more to less than 0.20 μm precipitate during hot rolling, the subsequent cooling, and first aging treatment, they are mostly solutionized in solution treatment, and are precipitated by the subsequent cooling and (the second) aging treatment. The second phase particles having diameters of less than 0.05 μm are solutionized in solution treatment, and a large amount thereof is precipitated by (the second) aging treatment. Accordingly, these second phase particles do not show the effect of adjusting grain size, but contribute to improvement in strength.

3. Physical Properties of Alloy Material

The electrical conductivity EC of the alloy material of the present invention is 60% IACS or more, preferably 65% IACS or more. Parts that allow high current can be manufactured when EC is within this range.

Good bending workability as used in the present invention refers to a minimum bending radius MBR/t of 0.5 or less (Bad Way) at 0.3 mm sheet thickness. If MBR/t is 0.5 or less for at 0.3 mm sheet thickness, properties demanded for manufacture and use of electronic parts, in particular movable connectors are fulfilled. Further, better bending workability is obtained when the alloy material of the present invention is made to be thinner than 0.3 mm thickness.

The 0.2% yield strength YS of the alloy material of the present invention is preferably 600 MPa or more, further preferably 650 MPa or more, and the tensile strength TS is preferably 630 MPa or more, further preferably 660 MPa or more. Values within the above range are sufficient especially for electronic parts material such as a plate material for movable connectors.

4. Manufacturing Method

The manufacturing process steps of the alloy material of the present invention are the same or similar to those for an ordinary precipitation strengthened copper alloy, i.e., melt casting→(homogenizing heat treatment)→hot rolling→cooling→(first aging treatment)→grinding→cold rolling→solution treatment→cooling→(cold rolling)→second aging treatment→final cold rolling→(stress relief annealing). Steps in parentheses can be omitted, and final cold rolling may be performed before aging heat treatment.

Although homogenizing heat treatment and hot rolling are performed after casting in the present invention, homogenizing heat treatment may be the heating in hot rolling (in the present specification, heating performed during homogenizing heat treatment and hot rolling is collectively referred to as "hot heating").

The hot heating temperature may be any temperature at which the supplemented elements mostly solutionize, specifically, it may be a temperature that is 40° C. or more, preferably 45° C. or more higher than the solution treatment temperature selected below. The upper limit of the hot rolling temperature is individually regulated depending on the metal composition and facility, and is ordinarily 1000° C. or less. The heating time will depend on plate thickness, and is preferably 30 to 500 minutes, further preferably 60 to 240 minutes. It is preferred that most of the supplemented elements such as Co or Si melt during hot heating.

The cooling rate after hot heating is 5 to 100° C./min, further preferably 5 to 50° C./min. With this cooling rate, second phase particles ultimately having diameters of from 0.20 μm to 5.00 μm will precipitate in the target range. However, only fine second phase particles were conventionally precipitated, since quenching by a water-cooling shower etc. with the aim of suppressing the coarsening of second phase particles.

Materials are ground after cooling, and an arbitrary first aging treatment is preferably further performed to allow adjusting of the target size and number of second phase particles. The conditions for this first aging treatment are preferably at 600 to 800° C. for 30 s to 10 h, but may also be 15 h.

The temperature of solution treatment performed after the above arbitrary first aging treatment is selected from the range of from (50×Co wt %+775)° C. or more to (50×Co wt %+825)° C. or less. The preferred treatment time is 30 to 500 s, further preferably 60 to 200 s. Within this range, the adjusted second phase particles remain resided to prevent the enlargement of grain size, while finely precipitated Co and Si are sufficiently solutionized and precipitated as fine second phase particles by the later second aging treatment.

The preferred cooling rate after solution treatment is 10° C./s or higher. A cooling rate slower than the above is will cause precipitation of second phase particles during cooling, and the amount of solubility will decrease. There is no particularly preferred upper limit for the cooling rate, but e.g. approximately 100° C./s is possible for a generally employed facility.

If the amounts of Co and Si contained are lower than that in the present invention, or not slowly cooled after hot rolling and second aging treatment heating is not performed, there are only a little second phase particles that are precipitated before solution treatment. When an alloy having only a little precipitated second phase particles is subjected to solution treatment, since an elevated temperature higher than 900° C. for a solution treatment time longer than 1 minute will cause coarsening of grain size, heat treatment can be performed only for a short duration of approximately 30 seconds and the actual solutionizable amount is low, and therefore sufficient precipitation strengthening effect cannot be obtained.

The temperature of second aging treatment after solution treatment is preferably at 500° C. to 650° C. for 1 to 20 hours. Within this range, the diameters of the second phase particles remaining after solution treatment can be maintained within the range of the present invention, as well as the solutionized supplemented elements will precipitate as fine second phase particles and contribute to strength enhancement.

The final rolling reduction ratio is preferably 5 to 40%, further preferably 10 to 20%. A ratio of less than 5% will result in insufficient increase in strength by work hardening, while greater than 40% will result in decrease in bending workability.

Moreover, if final cold rolling is performed before second age treatment, the second age treatment may be performed at 450° C. to 600° C. for 1 to 20 hours.

The straightening annealing temperature is preferably 250 to 600° C., and the annealing time preferably 10 s to 1 hour. Within this range, there is no change in the size and number of second phase particles as well as in grain size.

EXAMPLES

1. Preparation

To a molten metal liquid made of electrolytic copper, Si, and Co as raw materials, supplementing elements were added varying the amount and type, and the molten metal was casted into an ingot having a thickness of 30 mm. The ingot was heated at the temperature shown in the table for 3 hours, hot rolled into plates having a thickness of 10 mm. Next, oxyded scales on the surface were ground and removed, subjected to aging treatment for 15 hours and then to solution treatment using appropriately varied temperature and time, cooled at the cooling temperature shown in the table, subjected to 1 to 15 hours of aging treatment at the temperature shown in the table, and finished to a final thickness of 0.3 mm by final cold rolling. Straightening annealing time is 1 minute.

2. Evaluation

The concentrations of supplemented elements in the copper alloy matrix were analyzed by ICP-mass spectrometry using samples after the grinding step.

For the diameter and number of second phase particles, a cross-section parallel to the rolling direction of the sample before final cold rolling was mirror finished by means of mechanical polishing, followed by electrolytic polishing or acid wash etching, and determined from five microscope photographs for each magnification using a scanning electron microscope. Observation magnification is (a) $5\times10^4$-power for from 0.05 μm or more to less than 0.20 μm, (b) $1\times10^4$-power for from 0.20 μm or more to less than 1.00 μm, and (c) $1\times10^3$-power for from 1.00 μm or more to less than 5.00 μm.

For the grain size, average grain size was measured according to JIS H0501 by section method.

For the electrical conductivity EC, specific resistance was measured by a four-terminal method in a thermostatic bath maintained at 20° C. (±0.5° C.) (distance between terminals: 50 mm).

For the bending workability MBR/t, a 90° W bend test (JIS H3130, Bad Way) of short test strips (width 10 mm×length 30 mm×thickness 0.3 mm) taken in T.D. (Transverse Direction) so that the bending axis is perpendicular to the rolling direction was performed, and the minimum bending radius without generation of cracks (mm) was referred to as the MBR (Minimum Bend Radius) and the ratio thereof to the plate thickness t (mm), MBR/t was evaluated.

For the 0.2% yield strength YS and tensile strength TS, sample JIS Z2201-13B size out in the direction parallel to the rolling was measured for three times according to JIS Z 2241, and the average was calculated.

The results are shown in Tables 1 to 3. The grain sizes in Table 3 represent 50 nm or more to less than 200 nm, 200 nm or more to less than 1000 nm, and 1000 nm or more to 5000 nm or less. Second phase particles larger than 5000 nm (5.00 μm) were not observed. Digits are altered because the number logarithmically decreases with increasing diameters.

Since Examples 1 to 6 fulfill the requirements of the present invention, they have excellent electrical conductivity, strength, and bending workability at the sheet thickness, and were materials suitable for movable connectors which allow high current. Reference Invention Example 1 is produced under the same conditions as in Example 2, with the exception that after solution treatment, cooled at the cooling temperature shown in the table, finished to a final thickness of 0.3 mm in final cold rolling, subjected to aging treatment at the temperature shown in the table, and then to stress relief annealing. It is slightly poor in strength compared to Example 2, but bendability is slightly improved.

Comparative Example 8 has low Co concentration as well as fast cooling rate after hot working, so the number of second phase particles of from 0.20 μm or more to less than 1.00 μm and the number of second phase particles of from 1.00 to 5.00 μm were both low, and the grain size is at the upper limit. Moreover, strength is relatively low since the solution treatment time is relatively short and the solubilitized amount is small. In order to compensate for this, the reduction ratio was increased to secure strength, resulted in poor bending workability. Comparative Example 9 has low Co concentration and thus strength is low.

In Comparative Example 10, the solution treatment temperature is too high, so the second phase particles having diameters of from 0.20 μm or more to less than 1.00 μm have disappeared during solution heat treatment, and the effect of suppressing the growth of crystal grains could not be exerted and bendability became bad.

Comparative Example 11 has low Co/Si ratio and Comparative Example 12 has high Co/Si ratio. Neither could obtain precipitation strengthening effect attained by fine second phase particles, and electrical conductivities are also poor in these Comparative Examples because solutionized amount of Co or Si is high.

In Comparative Example 13, since the cooling rate after hot rolling was too slow, second phase particles having diameters of from 1.00 to 5.00 μm increased and bendability became bad.

Comparative Example 14 had a fast cooling rate after hot rolling, the number of second phase particles of from 0.20 μm or more to less than 1.00 μm and the number of second phase particles having diameters of from 1.00 to 5.00 μm were low, thus the effect of suppressing the growth of crystal grains could not be exerted and bendability became bad. Similarly, in Comparative Example 15, the cooling rate after hot working was also faster while first aging treatment was performed at a high temperature resulting that the second phase particles having diameters of from 0.20 μm or more to less than 1.00 μm precipitated. However, the number of second phase particles having diameters of from 1.00 to 5.00 μm was low, and grain size became large due to heating in the first aging treatment, thus bendability became bad.

In Comparative Example 16, hot rolling temperature and solution treatment temperature are higher than in Example 4, so the effect of suppressing the growth of crystal grains could not be exerted, and bendability became bad and electrical conductivity is also lower than that in Example 4.

Comparative Example 17 has lower solution treatment temperature and faster cooling temperature after solution treatment compared to Example 7, and thus the second phase particles having diameters of from 0.20 μm or more to less than 1.00 μm and the number of second phase particles having diameters of from 1.00 to 5.00 μm are higher, and bendability became bad and strength is also lower than that in Example 7.

Comparative Example 18 has high Co concentration, and thus a higher solution treatment temperature and a longer treatment time were necessary. Therefore the number of second phase particles having diameters of from 0.20 μm or more to less than 1.00 μm was higher and bendability became bad.

Comparative Example 19 has high Co concentration, and the solution treatment temperature and hot working temperature were the same. Thus, the effect of suppressing the growth of grain size could not be exerted, and the number of second phase particles having diameters of from 0.20 μm or more to less than 1.00 μm was low and the number of second phase particles having diameters of from 1.00 to 5.00 μm was high, then bendability became bad.

TABLE 1

| | Component | | | Hot rolling | Cooling | Aging | 50 × Co wt % + 775 Lower | Solution treatment | | Cooling | Aging | Final rolling Reduction | Stress relief annealing |
|---|---|---|---|---|---|---|---|---|---|---|---|---|---|
| | Co wt % | Si wt % | Co/Si | Temp. ° C. | Rate ° C./min | Temp. ° C. | limit ° C. | Temp. ° C. | Time s | Rate ° C./sec | Temp. ° C. | ratio % | Temp. ° C. |
| Ex. 1 | 1.5 | 0.4 | 3.8 | 900 | 10 | 600 | 850 | 850 | 100 | 10 | 550 | 10 | 500 |
| Ex. 2 | 1.7 | 0.4 | 4.3 | 980 | 35 | 600 | 860 | 875 | 100 | 20 | 540 | 10 | 500 |
| Ex. 3 | 1.7 | 0.4 | 4.3 | 980 | 35 | — | 860 | 875 | 100 | 20 | 540 | 10 | 500 |
| Ex. 4 | 1.9 | 0.45 | 4.2 | 950 | 30 | 600 | 870 | 900 | 100 | 20 | 530 | 10 | 500 |
| Ex. 5 | 2.1 | 0.5 | 4.2 | 975 | 35 | 600 | 880 | 925 | 100 | 20 | 520 | 10 | 500 |
| Ex. 6 | 2.3 | 0.46 | 5.0 | 990 | 40 | 600 | 890 | 940 | 100 | 20 | 510 | 10 | 500 |
| Ex. 7 | 2.5 | 0.7 | 3.6 | 1000 | 45 | 600 | 900 | 950 | 100 | 10 | 500 | 10 | 500 |
| Comp. Ex. 8 | 1.4 | 0.35 | 4.0 | 1000 | 200 | — | 845 | 925 | 30 | 50 | 525 | 20 | 350 |
| Comp. Ex. 9 | 1.4 | 0.35 | 4.0 | 900 | 10 | 600 | 845 | 850 | 100 | 10 | 550 | 10 | 500 |
| Comp. Ex. 10 | 1.5 | 0.36 | 4.2 | 980 | 35 | 600 | 850 | 930 | 100 | 20 | 550 | 10 | 500 |
| Comp. Ex. 11 | 1.7 | 0.6 | 2.8 | 950 | 30 | 600 | 860 | 875 | 100 | 20 | 520 | 10 | 500 |
| Comp. Ex. 12 | 1.7 | 0.3 | 5.7 | 950 | 30 | 600 | 860 | 875 | 100 | 20 | 520 | 10 | 500 |
| Comp. Ex. 13 | 1.7 | 0.4 | 4.3 | 950 | 3 | — | 860 | 875 | 100 | 20 | 520 | 10 | 500 |
| Comp. Ex. 14 | 1.7 | 0.4 | 4.3 | 950 | 200 | 650 | 860 | 875 | 100 | 20 | 540 | 10 | 500 |
| Comp. Ex. 15 | 1.7 | 0.4 | 4.3 | 950 | 200 | 800 | 860 | 875 | 100 | 20 | 540 | 10 | 500 |
| Comp. Ex. 16 | 1.9 | 0.45 | 4.2 | 1000 | 45 | 600 | 870 | 950 | 100 | 20 | 530 | 10 | 500 |
| Comp. Ex. 17 | 2.5 | 0.60 | 4.2 | 1000 | 45 | 600 | 900 | 900 | 100 | 20 | 510 | 10 | 500 |
| Comp. Ex. 18 | 2.7 | 0.64 | 4.2 | 1000 | 45 | 600 | 910 | 950 | 1000 | 20 | 500 | 10 | 500 |
| Comp. Ex. 19 | 2.7 | 0.64 | 4.2 | 1000 | 45 | 600 | 910 | 1000 | 100 | 20 | 500 | 10 | 500 |
| Ref. Inv. Ex. 1 | 1.7 | 0.4 | 4.3 | 980 | 35 | 600 | 860 | 875 | 100 | 20 | 500 | 10 | 500 |

TABLE 2

| | Mechanical and physical properties | | | | | Second phase particles after second aging treatment | | |
|---|---|---|---|---|---|---|---|---|
| | YS MPa | TS MPa | EC % IACS | GS μm | R/t (B.W.) | 50-200 nm ×1000000/mm$^2$ | 200-1000 nm /mm$^2$ | 1000-5000 nm /mm$^2$ |
| Ex. 1 | 600 | 640 | 65 | 5 | 0.0 | 5 | 14000 | 40 |
| Ex. 2 | 640 | 670 | 66 | 7 | 0.1 | 0.3 | 18000 | 80 |
| Ex. 3 | 650 | 670 | 65 | 7 | 0.25 | 1 | 20000 | 100 |
| Ex. 4 | 650 | 670 | 65 | 7 | 0.25 | 1 | 20000 | 100 |
| Ex. 5 | 670 | 710 | 63 | 9 | 0.25 | 6 | 16000 | 200 |
| Ex. 6 | 710 | 745 | 62 | 10 | 0.4 | 5 | 90000 | 160 |
| Ex. 7 | 750 | 777 | 60 | 10 | 0.4 | 7 | 80000 | 300 |
| Comp. Ex. 8 | 600 | 660 | 65 | 10 | 1.0 | 0.1 | 2000 | 0 |
| Comp. Ex. 9 | 590 | 620 | 67 | 5 | 0.0 | 3 | 10000 | 20 |
| Comp. Ex. 10 | 620 | 660 | 65 | 25 | 1.5 | 2 | 2000 | 100 |
| Comp. Ex. 11 | 580 | 620 | 46 | 7 | 0.1 | 0.25 | 12000 | 60 |
| Comp. Ex. 12 | 570 | 620 | 56 | 7 | 0.1 | 0.2 | 10000 | 40 |
| Comp. Ex. 13 | 620 | 650 | 68 | 7 | 2.0 | 0.3 | 20000 | 1500 |
| Comp. Ex. 14 | 640 | 660 | 65 | 15 | 1.0 | 0.15 | 2000 | 0 |
| Comp. Ex. 15 | 630 | 660 | 66 | 20 | 1.0 | 1 | 70000 | 0 |
| Comp. Ex. 16 | 710 | 740 | 60 | 20 | 1.0 | 0.1 | 6000 | 40 |
| Comp. Ex. 17 | 660 | 700 | 62 | 3 | 1.0 | 12 | 110000 | 1200 |
| Comp. Ex. 18 | 750 | 777 | 60 | 8 | 1.0 | 16 | 210000 | 100 |
| Comp. Ex. 19 | 770 | 800 | 58 | 15 | 2.0 | 0.15 | 2000 | 2000 |
| Ref. Inv. Ex. 1 | 610 | 650 | 66 | 7 | 0.0 | 0.3 | 18000 | 80 |

Although the present invention is not limited to theory, the relationship between the steps of manufacture and the disappearance and precipitation of second phase particles is thought to be as follows. The supplemented element(s) solutionize into copper during hot heating. Second phase particles having a diameter of 0.05 μm or more will precipitate during hot rolling and in the cooling stage after the hot rolling where the cooling rate is adjusted. In first aging treatment after the hot rolling, second phase particles having a diameter of 0.05 μm or more do not precipitate, while second phase particles having a diameter of less than 0.05 μm precipitate in large amounts. The precipitated second phase particles having a diameter of less than 0.20 μm will disappear by solutionization in solution treatment where the temperature is adjusted. In cooling stage after the solution treatment where cooling rate is adjusted, the second phase particles having a diameter of from 0.05 μm or more to less than 0.2 μm will mainly precipitate in small amounts. In second aging treatment after the solution treatment, second phase particles having a diameter of less than 0.05 μm will precipitate in large amounts.

Table 3 shows the measurement results of how second phase particles having diameters of (a) from 0.05 μm or more to less than 0.20 μm, (b) from 0.20 μm or more to less than 1.00 μm, and (c) from 1.00 μm or more to less than 5.00 μm changed in the manufacturing steps. Table 3 confirms the following for (a) to (c) particles respectively.

Particles (a) will solutionize under the solution treatment conditions of the present invention and the number will be reduced to approximately one fifth to one tenth, and the number after second aging treatment does not vary relatively. There is almost no increase or decrease in the number of particles (b) under the solution treatment conditions and the second aging treatment conditions of the present invention. There is no change in the number of particles (c) before solution treatment and before final cold rolling under hot heating and cooling conditions of the present invention.

The invention claimed is:

1. A Cu—Co—Si alloy material consisting of 1.5 to 2.5 wt % of Co and 0.3 to 0.7 wt % of Si and the balance of Cu and unavoidable impurities, having a Co/Si element ratio of 3.5 to 5.0, wherein the said alloy material contains 3,000 to 150,000 second phase particles per $mm^2$ having diameters of from 0.20 μm or more to less than 1.00 μm, and has an electrical conductivity EC of 60% IACS or more, a grain size of 10 μm or less, and good bending workability.

2. The Cu—Co—Si alloy material according to claim 1, wherein the alloy material contains 10 to 1,000 second phase particles per $mm^2$ having diameters of from 1.00 μm or more to 5.00 μm or less.

3. The Cu—Co—Si alloy material according to claim 1, wherein the 0.2% yield strength YS is 600 MPa or more.

4. A method of manufacturing the Cu—Co—Si alloy material according to any one of claims 1 to 3 comprising the steps of casting, hot rolling and solution treatment, wherein a temperature of hot heating performed after casting and before solution treatment is 45° C. or more higher than the solution

TABLE 3

| Grain size | Before first aging treatment | | | After first aging treatment, before solution treatment | | |
|---|---|---|---|---|---|---|
| Nm Number/$mm^2$ | 50-200 ×1000000 | 200-1000 ×1 | 1000-5000 ×1 | 50-200 ×1000000 | 200-1000 ×1 | 1000-5000 ×1 |
| Ex. 1 | 0 | 14000 | 40 | 50 | 14000 | 40 |
| Ex. 2 | 0 | 16000 | 80 | 2.4 | 16000 | 80 |
| Ex. 3 | 0 | 16000 | 80 | 0.01 | 16000 | 80 |
| Ex. 4 | 0 | 18000 | 100 | 9 | 18000 | 100 |
| Ex. 5 | 0 | 16000 | 200 | 30 | 16000 | 200 |
| Ex. 6 | 0 | 110000 | 160 | 35 | 110000 | 160 |
| Ex. 7 | 0 | 90000 | 300 | 42 | 90000 | 300 |
| Comp. Ex. 8 | 0.6 | 4000 | 0 | 0.6 | 4000 | 0 |
| Comp. Ex. 9 | 0 | 10000 | 20 | 20 | 10000 | 20 |
| Comp. Ex. 10 | 0 | 2000 | 100 | 10 | 2000 | 100 |
| Comp. Ex. 11 | 0 | 16000 | 60 | 2 | 16000 | 60 |
| Comp. Ex. 12 | 0 | 12000 | 40 | 4 | 12000 | 40 |
| Comp. Ex. 13 | 0 | 16000 | 2000 | 0 | 16000 | 2000 |
| Comp. Ex. 14 | 0.8 | 3000 | 0 | 15 | 3000 | 0 |
| Comp. Ex. 15 | 0.6 | 3000 | 0 | 1 | 100000 | 0 |
| Comp. Ex. 16 | 0 | 18000 | 100 | 10 | 18000 | 100 |
| Comp. Ex. 17 | 0 | 120000 | 1200 | 132 | 120000 | 1200 |
| Comp. Ex. 18 | 0 | 230000 | 100 | 112 | 230000 | 100 |
| Comp. Ex. 19 | 0 | 2000 | 2000 | 1.35 | 2000 | 2000 |
| Ref. Inv. Ex. 1 | 0 | 16000 | 80 | 2.4 | 16000 | 80 |

| Grain size | After solution treatment | | | After second aging treatment | | |
|---|---|---|---|---|---|---|
| Nm Number/$mm^2$ | 50-200 ×1000000 | 200-1000 ×1 | 1000-5000 ×1 | 50-200 ×1000000 | 200-1000 ×1 | 1000-5000 ×1 |
| Ex. 1 | 4.5 | 14000 | 40 | 5 | 14000 | 40 |
| Ex. 2 | 0.35 | 20000 | 80 | 0.3 | 18000 | 80 |
| Ex. 3 | 0.15 | 20000 | 80 | 0.2 | 18000 | 80 |
| Ex. 4 | 1.1 | 20000 | 100 | 1 | 20000 | 100 |
| Ex. 5 | 5.5 | 16000 | 200 | 6 | 16000 | 200 |
| Ex. 6 | 5.5 | 90000 | 160 | 5 | 90000 | 160 |
| Ex. 7 | 6.5 | 86000 | 300 | 7 | 80000 | 300 |
| Comp. Ex. 8 | 0.15 | 4000 | 0 | 0.1 | 2000 | 0 |
| Comp. Ex. 9 | 3 | 10000 | 20 | 3 | 10000 | 20 |
| Comp. Ex. 10 | 3 | 2000 | 100 | 2 | 2000 | 100 |
| Comp. Ex. 11 | 2.5 | 14000 | 60 | 0.25 | 12000 | 60 |
| Comp. Ex. 12 | 1.5 | 10000 | 40 | 0.2 | 10000 | 40 |
| Comp. Ex. 13 | 0.3 | 18000 | 1500 | 0.3 | 20000 | 1500 |
| Comp. Ex. 14 | 0.15 | 2000 | 0 | 0.15 | 2000 | 0 |
| Comp. Ex. 15 | 1 | 70000 | 0 | 1 | 70000 | 0 |
| Comp. Ex. 16 | 0.15 | 4000 | 40 | 0.1 | 6000 | 40 |
| Comp. Ex. 17 | 13.25 | 110000 | 1200 | 12 | 110000 | 1200 |
| Comp. Ex. 18 | 16 | 220000 | 100 | 16 | 210000 | 100 |
| Comp. Ex. 19 | 17 | 4000 | 2000 | 0.15 | 2000 | 2000 |
| Ref. Inv. Ex. 1 | 0.35 | 20000 | 80 | 0.3 | 18000 | 80 |

treatment temperature selected below, a cooling rate from the temperature at the start of hot rolling to 600° C. is 100° C./min or lower, and the solution treatment temperature is selected from the range of from (50×Co wt %+775)° C. or more to (50×Co wt %+825)° C. or less.

5. The method of manufacturing the Cu-Co-Si alloy material according to claim 4, comprising performing a step of ageing treatment after solution treatment wherein the aging treatment is conducted at 450 to 650° C. for 1 to 20 hours.

* * * * *